US008881714B1

(12) United States Patent
Cooper

(10) Patent No.: US 8,881,714 B1
(45) Date of Patent: Nov. 11, 2014

(54) COMPOUND BOW

(75) Inventor: Gary Cooper, Jonesboro, AR (US)

(73) Assignee: Slick Trick, LLC, Henrietta, NY (US)

( * ) Notice: Subject to any disclaimer, the term of this patent is extended or adjusted under 35 U.S.C. 154(b) by 569 days.

(21) Appl. No.: 13/185,037

(22) Filed: Jul. 18, 2011

Related U.S. Application Data

(60) Provisional application No. 61/364,920, filed on Jul. 16, 2010.

(51) Int. Cl.
*F41B 5/10* (2006.01)

(52) U.S. Cl.
CPC ..... *F41B 5/105* (2013.01); *Y10S 124/90* (2013.01)
USPC ..... 124/25.6; 124/23.1; 124/86; 124/88; 124/90; 124/900

(58) Field of Classification Search
CPC ..... F41B 5/105; Y10S 124/90
USPC ..... 124/23.1, 25.6, 86, 88, 900
See application file for complete search history.

(56) References Cited

U.S. PATENT DOCUMENTS 3,486,495 A * 12/1969 Holless ..... 124/25.6
3,851,638 A * 12/1974 Alexander ..... 124/25.6
3,990,425 A * 11/1976 Ketchum ..... 124/25.6
4,112,909 A * 9/1978 Caldwell ..... 124/25.6
4,368,718 A * 1/1983 Simonds et al. ..... 124/25.6
4,401,097 A * 8/1983 Simonds et al. ..... 124/25.6
4,438,753 A * 3/1984 Simonds ..... 124/25.6
4,455,990 A * 6/1984 Barna ..... 124/86
4,512,326 A * 4/1985 Jarrett ..... 124/25.6
4,774,927 A * 10/1988 Larson ..... 124/25.6
4,838,236 A * 6/1989 Kudlacek ..... 124/25.6
4,886,038 A * 12/1989 Betters ..... 124/25.6
4,926,832 A * 5/1990 Darlington ..... 124/25.6
4,986,250 A * 1/1991 Darlington ..... 124/25.6
4,995,373 A * 2/1991 Mussack ..... 124/25.6
5,368,006 A * 11/1994 McPherson ..... 124/25.6
5,649,522 A * 7/1997 Troncoso ..... 124/25.6
5,678,529 A * 10/1997 Larson ..... 124/25.6
5,791,322 A * 8/1998 McPherson ..... 124/25.6
5,890,480 A * 4/1999 McPherson ..... 124/25.6
5,934,265 A * 8/1999 Darlington ..... 124/25.6
5,960,778 A * 10/1999 Larson ..... 124/25.6
5,975,067 A * 11/1999 Strother ..... 124/25.6
6,112,732 A * 9/2000 Larson ..... 124/25.6
6,237,582 B1 * 5/2001 McPherson ..... 124/25.6
RE37,544 E * 2/2002 Darlington ..... 124/25.6
6,446,619 B1 * 9/2002 McPherson ..... 124/25.6
6,470,870 B1 * 10/2002 Schaar ..... 124/25.6
6,666,202 B1 * 12/2003 Darlington ..... 124/25.6
6,688,295 B1 * 2/2004 Miller ..... 124/25.6
6,990,970 B1 * 1/2006 Darlington ..... 124/25.6
6,994,079 B1 * 2/2006 Darlington ..... 124/25.6

(Continued)

*Primary Examiner* — Gene Kim
*Assistant Examiner* — Alexander Niconovich
(74) *Attorney, Agent, or Firm* — Hiscock & Barclay, LLP

(57) ABSTRACT

An archery bow has upper and lower rotatable draw force modules. The draw force modules each define first and second grooves. The bowstring and a first cable are anchored in the first groove; and a second cable is anchored in the second groove. The design of the draw force modules and the anchoring of the bowstring and cables to the draw force modules allows the cable pull to be more centered to the limb during operation yielding less limb twist and draw force module lean, resulting in improved durability and accuracy.

10 Claims, 3 Drawing Sheets

(56) References Cited

U.S. PATENT DOCUMENTS

| | | | | |
|---|---|---|---|---|
| 7,143,757 | B1 * | 12/2006 | Cooper | 124/25.6 |
| 7,305,979 | B1 * | 12/2007 | Yehle | 124/25.6 |
| 7,441,555 | B1 * | 10/2008 | Larson | 124/25.6 |
| 7,997,259 | B2 * | 8/2011 | Wilson | 124/25.6 |
| 8,006,679 | B2 * | 8/2011 | Strother | 124/25.6 |
| 8,020,544 | B2 * | 9/2011 | McPherson et al. | 124/25.6 |
| 8,205,607 | B1 * | 6/2012 | Darlington | 124/25.6 |
| 8,276,574 | B1 * | 10/2012 | Wilson | 124/25.6 |
| 8,281,774 | B2 * | 10/2012 | Grace | 124/25.6 |
| 8,281,775 | B1 * | 10/2012 | Larson | 124/25.6 |
| 8,360,041 | B2 * | 1/2013 | Strother | 124/25.6 |
| 8,371,283 | B2 * | 2/2013 | Grace et al. | 124/88 |
| 8,534,269 | B2 * | 9/2013 | Wilson et al. | 124/25.6 |
| 2011/0023857 | A1 * | 2/2011 | Grace | 124/25.6 |

* cited by examiner

COMPOUND BOW

CROSS-REFERENCE TO RELATED APPLICATIONS

This application claims priority from Provisional Application No. 61/364,920, filed Jul. 16, 2010, which is hereby incorporated by reference.

BACKGROUND OF THE INVENTION

Early bows consisted of a simple stick with a string attached to each end. In 1969, U.S. Pat. No. 3,486,495 (which is incorporated herein by reference) was granted to Holless Allen for a compound bow. By providing eccentric leverage draw force modules on the end of limbs with operating cabling, the force draw curve of the Allen compound bow could be manipulated to store more energy during the draw cycle, firing a faster arrow and lessening the holding weight at full draw, thereby allowing better aiming. As the bowstring was pulled, it was unspooled from the draw force modules, while cabling pulling on the opposing limbs was spooled on the draw force modules.

A problem is that one cam could move independently of another during letoff at the end of the draw. Thus there would be an inconsistent shift in nock travel at the string, anchor and release, resulting in inaccuracy.

Currently bows have become popular with cables from cams attaching to the opposite cams to synchronize the cams. However, a problem has risen with limb twist and cam lean due to the cable attachment to the cam. While drawing the bow, both the bowstring and cables pulling at their respective points near the center of the axle balance each other to effect a level limb and straight cam alignment.

However, near the end of the draw, letoff is accomplished by transferring the force of pull on the bowstring to the take up and letoff cables which hold the tension at full draw. Therefore in a bow with 80% letoff, 80% of the pull by the bowstring on the axle has been transferred over to the cam pull point on the axle. A problem with the design is that the cable pulling at a point away from the center of the axle causes limb twist and cam lean, resulting in limb stress and inaccuracy.

With a bowstring groove, a cable take up groove, and a cable let out groove, the cable pulls to the right of the axle, causing limb twist and cam lean.

An improvement was accomplished by using only two grooves, one for the bowstring groove, and using only one groove for both take up and let out cables. This results in the cable pulling closer to the center of the axle, reducing limb twist and cam lean. However, as tension was still transferred from the first bowstring groove to the second cable groove upon letoff, limb flex and draw force modules straightness was still negatively affected.

An additional problem with draw force modules is that the friction of the grooves causes string and cable wear and thus reduces the speed of the arrow.

Examples of some prior compound bows employing cam systems are shown in Ketchum (U.S. Pat. No. 3,990,425), Simonds et al. (U.S. Pat. No. 4,401,097), Simonds (U.S. Pat. No. 4,483,753), Miller (U.S. Pat. No. 6,688,295), Darlington (U.S. Pat. No. 6,990,970) and Larson (U.S. Pat. No. 7,441,555) all of which are incorporated herein by reference.

BRIEF SUMMARY

Briefly stated, a compound bow comprises a handle portion, and an upper limb and lower limb supported by the handle portion and extending from opposite ends of the handle portion. A first rotatable draw force module with two grooves is mounted on the top limb for rotation about an axle. A second rotatable draw force module with two grooves is mounted on the bottom limb for rotation about a second axle.

The two draw force modules can be substantially the same, with the top and bottom draw force modules being mirror images of each other (as seen from FIGS. 3A and 3B). Each draw force module defines a first groove and a second groove displaced laterally of the first groove. The first groove can be larger than the second groove, such that the second groove will have a circumference and/or radius smaller than the circumference and/or radius of the first groove. Each draw force module rotates around an axle or axis of rotation, and the draw force modules are configured such that the first and second grooves of a draw force module rotate together. Here, "radius" refers to, and means, the distance between the groove and the axle (or axis of rotation) for the draw force module. The axis of rotation is illustratively centered with respect to the second groove and off-center with respect to the first groove. The novel force draw module utilizes two grooves in the following manner: the bowstring and a first, take up, cable share the first of the two grooves, and the second of the two grooves receives a second, or let out, cable.

Now, when the bow goes into letoff, instead of the bowstring transferring much force over to the second, let out, groove, the force continues to pull on the first groove. Therefore when the bow is drawn and it goes into letoff at full draw, the limbs are center flexed, and the draw force modules are straight aligned, resulting in greater limb durability and accuracy.

A bowstring is attached to the top draw force module, is trained about a portion of the first groove, extends down to and is trained about a portion of the first groove of the bottom draw force module, and is attached to the bottom draw force module.

A first constraining cable is attached to the top draw force module and is positioned to engage a portion of the same groove the bowstring utilizes (i.e., the first constraining cable is secured in the first groove of the top draw force module). The first constraining cable extends down and is trained around the second groove on the bottom draw force module, and attaches to the bottom draw force module.

A second constraining cable is attached to the bottom draw force module and is positioned to engage a portion of the same groove the bowstring utilizes. That is, the second constraining cable and the bowstring are both anchored in the first groove of the bottom draw force module. The second constraining cable extends up and is trained around the second groove on the top draw force module, and attaches to the top draw force module.

As the bow is drawn, the bowstring is reeled off a portion of the first grooves of top and bottom draw force modules, causing the draw force modules (and hence the grooves of the draw force modules) to rotate. As the draw force modules are rotated by the pull on the bowstring, the constraining cables are reeled on to a portion of the first grooves of the top and bottom draw force modules, thereby compressing the limbs. At the same time, the constraining cables are reeled off of the second grooves of top and bottom draw force modules. This synchronizes the two draw force modules. A draw force curve for the compound bow is determined by the relative radii of the first and second grooves of the draw force modules.

Reducing bowstring draw force, or letoff as it is called, can be accomplished by rotating the draw force modules so that the cable radius of the first groove (e.g., the distance between the cable in the first groove and the axle) of the draw force module is reduced to a point where it is nearly equal to the radius of the second groove (e.g., the distance between the second groove and the axle) of the draw force modules, depending on degree of letoff desired. Customarily a draw stop is utilized to effect a desired letoff of less than 100%, so that the bowstring will reel forward when it is released, propelling the arrow. However, in the preferred embodiment, where the cable radius of the first groove is larger than the radius of the second groove, a draw stop is not necessary.

A further improvement to the draw force module is application of a low-friction coating, such as polytetrafluoroethylene, to the grooves of the draw force modules. By reducing friction, string and cables have reduced wear. With reduced friction on the groove contact points where the cables are spooling to the cable guard, efficiency is increased and greater speed is attained.

DESCRIPTION OF THE PREFERRED EMBODIMENT

Figure 1:
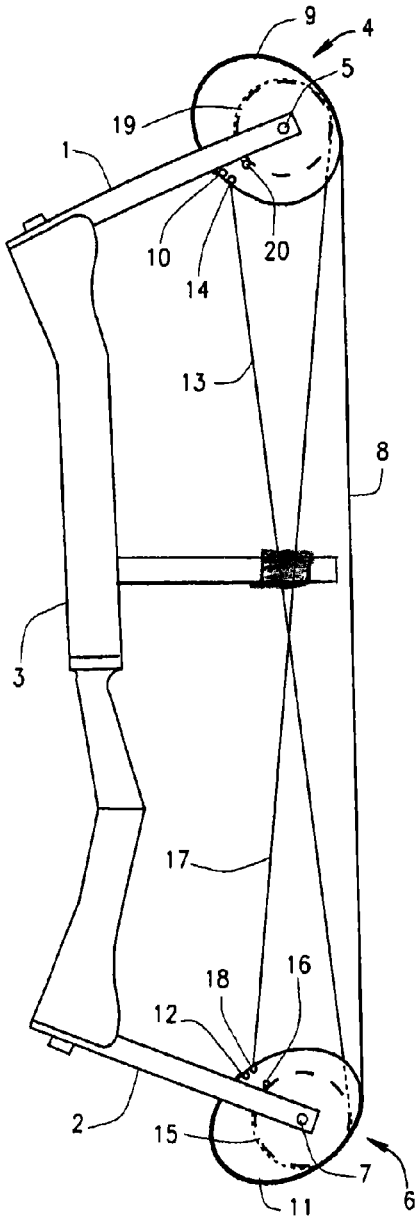
FIG. 1 is a side view of a compound bow provided with an illustrative embodiment of draw force modules.

As shown in FIG. 1, a compound archery bow comprises an upper limb 1 and a lower limb 2 which are connected to a bow handle 3 to extend from opposite sides of the bow handle. A first or upper draw force module 4 is rotatably mounted near the end of the limb 1 and a second or lower draw force module 6 rotatably mounted near the end of the limb 2. The upper draw force module 4 rotates about an axle 5 and the lower draw force module 6 rotates about an axle 7. As can be appreciated, the axles 5 and 7 define axis of rotation for the upper and lower draw force modules 4 and 6, respectively.

Figure 3A:
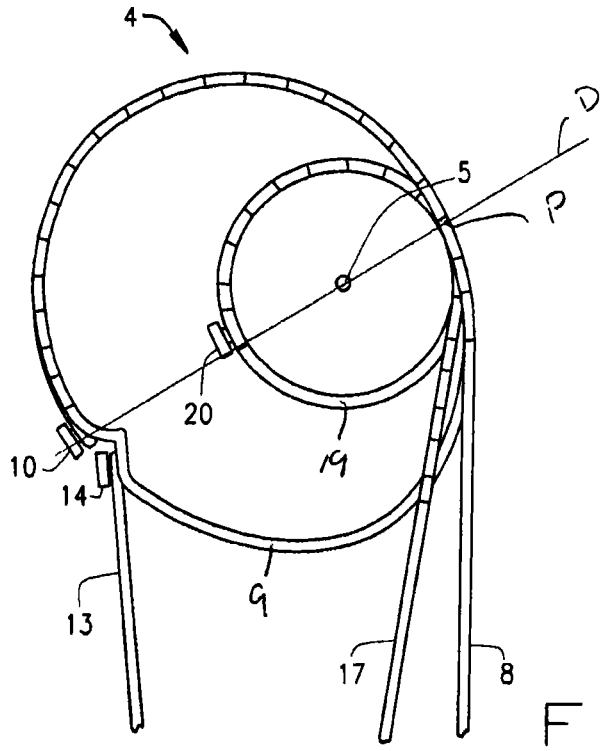
FIGS. 3A and B are side views of the upper and lower draw force modules (respectively), showing the points of connection of a bow string and constraining cables to the draw force modules.

The draw force modules 4 and 6 are generally identical. Each draw force module defines a first groove 9 and 11, respectively and a second groove 19 and 15, respectively. Illustratively, the first grooves 9 and 11 are larger in circumference than the second grooves 19 and 15. In a preferred embodiment, the first grooves 9 and 11 are non-circular and define a varying radius (and are thus cam shaped); and the second grooves 19 and 15 are generally circular, as seen in FIGS. 3A,B. The axles 5 and 7 (and thus the axes of rotation) for the draw force modules are generally centered with respect to the second grooves 19 and 15, and are off-center with respect to the first grooves 9 and 11. The first grooves 9 and 11 are thus eccentric. Additionally, the second grooves 19 and 15 are positioned relative to the first grooves 9 and 11 such that at a point P on the first and second grooves, the distance from the first and second grooves to the axle 5 or 7 is substantially the same.

The draw force modules are configured such that the first and second grooves of a draw force module rotate together. That is, the rotational position of the second grooves 19 and 15 do not change with respect to the rotational position of the associated first grooves 9 and 11. To this end, the draw force modules can each be formed as a unitary part. Alternatively, the first and second grooves can be formed on separate wheels which are then connected securely together, for example, using fasteners, such as glue, bolts, screws, etc. In a further example, the first and second grooves can be formed on separate wheels, and the two wheels are each keyed to the axle, such that the two wheels rotate together (and are rotationally fixed relative to each other). In a further alternative, the axle can be formed integrally with the draw force module (whether the two grooves are formed on a unitary piece or on separate wheels).

A bowstring 8 extends between the two limbs 1 and 2 having its opposite ends secured to the draw force modules 4 and 6. The bow string 8 is secured at anchor point 10 in the first groove 9 of the upper draw force module 4, extends around the groove 9 and down to the lower draw force module 6. At the lower draw force module, the bow string 8 extends around the first groove 11 to be secured to the first groove of the lower draw force module at anchor point 12.

A first cable 13 is secured at one end in the first groove 9 of the upper draw force module 4. As seen, the anchor point 14 is proximate (and below) the anchor point 10. The cable 13 extends downwardly from the upper draw force module 4 toward the lower force module. The cable 13 extends around the back of the second groove 15 of the lower draw force module to be secured at its opposite end to the lower draw force module 6 at anchor point 16.

A second cable 17 is secured at one end to an anchor point 20 in the second groove 19 of the upper draw force module. The cable 17 extends over and around the groove 19 and then extends downwardly toward the lower draw force module, where the cable 17 is connected at its opposite end at an anchor point 18 in the first groove 11 of the lower draw force module. As seen, the anchor point 18 is proximate (and above) the anchor point 12.

Figure 2:
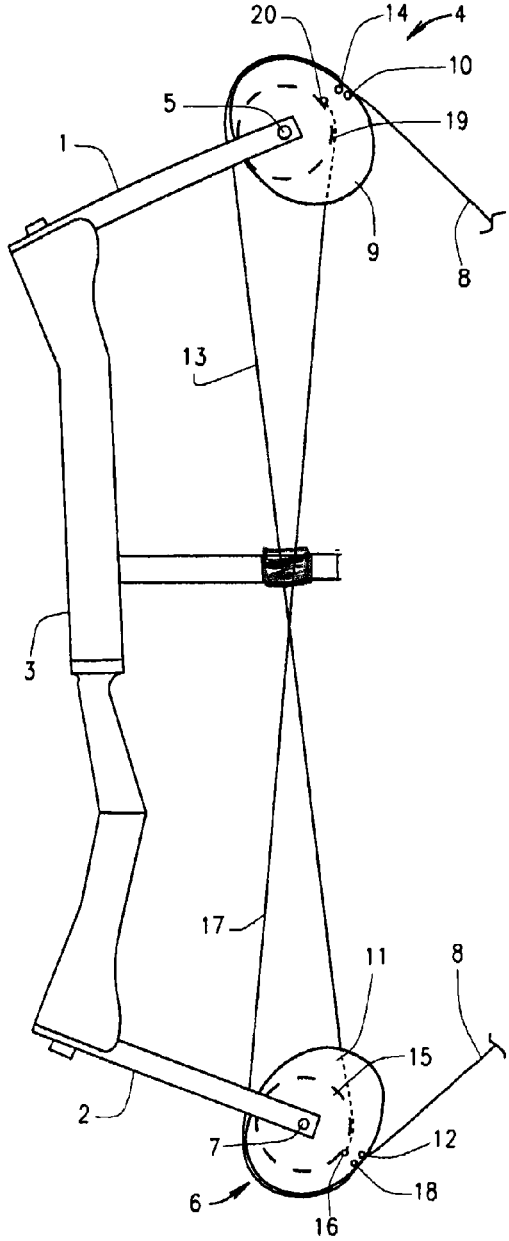
FIG. 2 is a side view of the bow of FIG. 1 at full draw.
Figure 5:
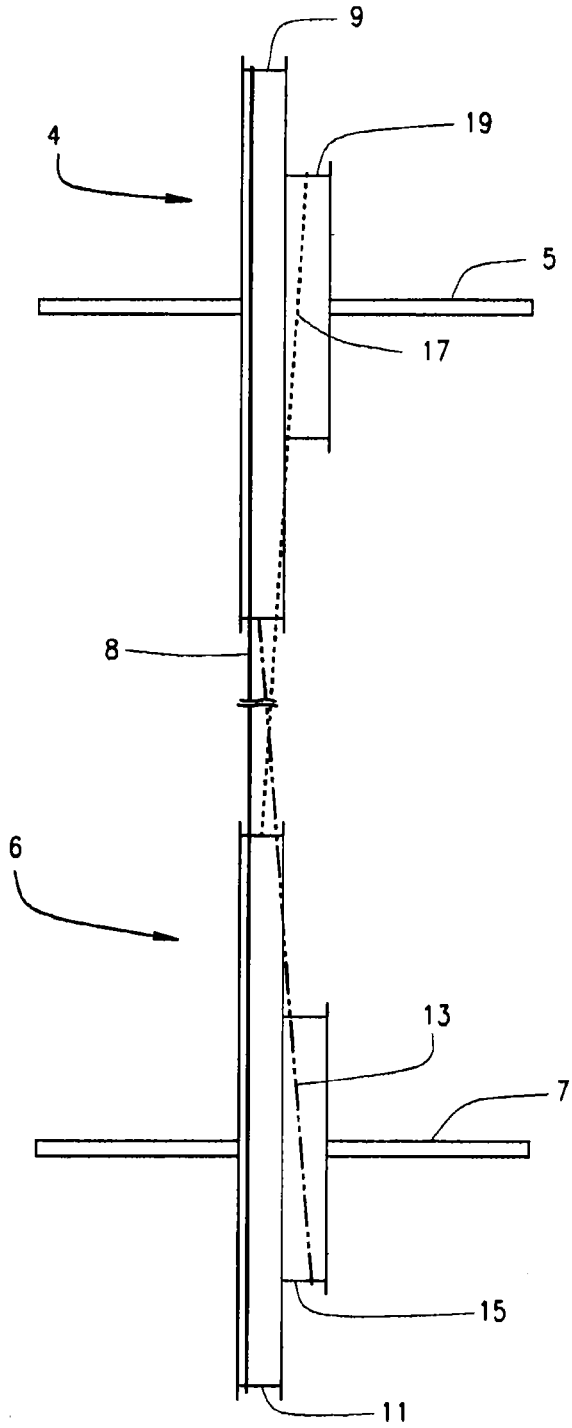
FIG. 5 is a rear elevation of the draw force modules in which the draw force modules have been stretched horizontally and the distance between the draw force modules has been reduced to schematically illustrative the relative positions of the bowstring and cables from a rear perspective of the bow.

Stated differently, the bow string 8 extends between the first grooves 9 and 11 of the upper and lower draw force modules 4 and 6, respectively. The first cable 13 extends between the first groove 9 of the upper draw force module 4 and the second groove 15 the lower draw force module 6. Lastly, the second cable 17 extends between the second groove 19 of the upper draw force module 4 and the first groove 11 of the lower draw force module 6. Thus, as seen in FIGS. 1 and 2 the cables 13 and 17 cross over each other when viewed in side elevation. In addition, as shown in FIG. 5, the cables 13 and 17 cross over each other when viewed from the rear (i.e., the perspective of the archer holding the bow). As noted above, in the view of FIG. 5, the draw force modules are stretched horizontally, and the distance between the upper and lower draw force modules has been reduced. This exaggerates the angle of the cables 13 and 17 relative to the vertical. Hence, in an actual bow, the cables 13 and 17 angles defied by the cables would be smaller, as can be seen, for example in FIGS. 3A and 3B; the actual cross-over point for the cables would be further from the draw force modules (again, as can be gleaned from FIGS. 3A and 3B; and the horizontal distance between the cables 13 and 17 at the location were they are shown to cross over in FIG. 5 would, in actuality, be greater. The bow can be provided with a cable separator (as shown in FIG. 2) to prevent the cables 13 and 17 from rubbing against each other.

In the illustrative embodiment, as seen in FIG. 3A, the anchor points 10 and 20 line on, or substantially close to, a line D which extends from point P through the axle 5. Thus, the anchor points 10 and 20 are about on the opposite side of the grooves 9 and 19, respectively, from the point P. A segment of the line D extending from the point P to the axle defines a radius of the second groove 19 and the shortest radius of the first groove 9. Additionally, the line segment extending from the axle 5 to the anchor point 10 defines substantially the longest radius of the first groove 9. The anchor point 20 lines on or substantially close to this segment of the line D.

Figure 3B:
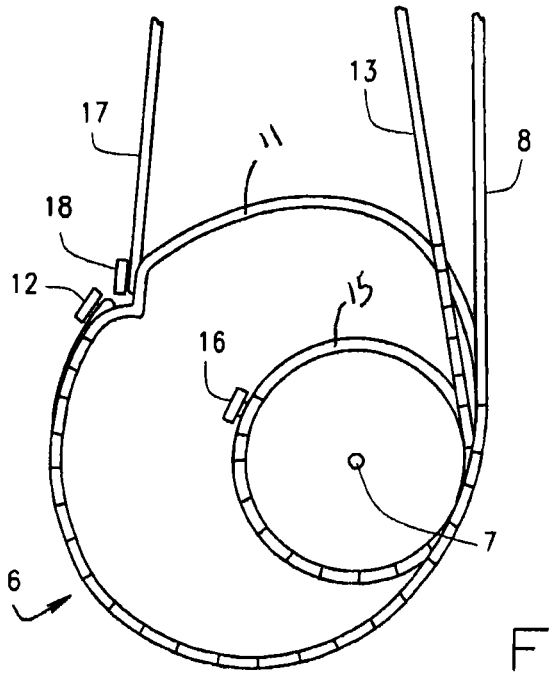
Figure 4:
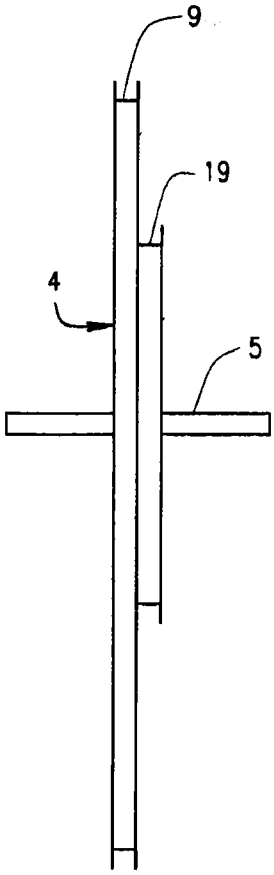
FIG. 4 is an end or rear elevational view of a draw force module.

As best seen in FIGS. 3A and 3B, when the bow is at a rest position (as shown in FIGS. 1 and 2), the bow string extends around at least a portion of the first grooves 9 and 11 of the upper and lower draw force modules 4 and 6, respectively. The cable 13 is at a forward point (i.e., facing toward the bow) of the first groove 9 of the upper draw force module 4 and extends directly toward the lower draw force module 6, where it extends around at least a portion of the second groove 15 to be anchored at a point facing the bow. The cable 17 is secured in opposition to the cable 13. Hence, the cable 17 is at a forward point (i.e., facing toward the bow) of the first groove of the lower draw force module 6 and extends directly toward the upper draw force module 4, where it extends around at least a portion of the second groove 19 to be secured in the second groove 19 at a position facing the bow.

Referring now to FIG. 3A, the draw force module 4 rotates on axle 5. Bow string 8 routes around the first groove 9 of the draw force module 4 and is attached at anchor point 10. The cable 13 also attaches to the first groove 9 of the draw force module 4 but at an anchor point 14. The cable 17 routes around the second groove 19 of the draw force module 4 attaching to anchor point 20. Thus, as seen, the cable 13 shares the first groove 9 with the bow string 8. As can be appreciated from the above description, and as shown in FIG. 3B, at the lower draw force module 6, the cable 17 and bow string 8 share the first groove 11, and the cable 13 is secured to the second groove 15.

The grooves of the draw force modules 4 and 6 can be coated with a low friction coating, such as polytetrafluoroethylene, as can the bowstring and cables. The application of a low-friction coating to the grooves of the draw force modules reduces friction between the draw force modules and the bow string 8 and cables 13, 17. This reduced friction will reduce wear on the bow string and cables have. With reduced friction on the groove contact points where the cables are spooling to the cable guard, efficiency is increased and greater speed is attained.

In addition to the specific embodiments disclosed, the invention is also directed to other embodiments having any possible combination of the invention as defined by the claims below. For instance the grooves of the draw force modules can be provided in many different shapes, draw stops may or may not be employed, different types of cable attachments may be used. Additionally, the axle need not be a separate piece, but may, for example, be formed integrally with its associated draw force module or with its associated limb.

As is known, when the bowstring of a compound bow is pulled, the force required to pull back the bowstring increases until peak weight is achieved. After this point, the force required to pull the bow string back decreases until letoff is reached. The respective shapes of the first grooves 9, 11 and the second grooves 19,15 of the draw force modules 4,6 will affect the draw force curve, and the amount (or distance) of pull of the bowstring to reach peak weight and letoff. Additionally, the draw force curve will be affected by the relative position of the anchor points of the bow string and cables on the first and second grooves.

The grooves or paths the string or cables take (i.e., the shape of the first and second grooves) may be any shape such as circular, eccentric, cam etc. Whatever draw force curve is desired may be achieved by changing the shape or shapes of the groove or path portions of the bowstring and cables.

In the embodiment shown, the first groove is non-circular and has a varying radius, and the second groove is circular. However, both grooves could be circular or both could be non-circular. Alternatively, the first groove could be circular, and the second groove could be non-circular. Further, in the illustrative embodiment, the upper and lower draw force modules are substantially identical. However, the grooves of the upper draw force module could be shaped differently or have a different circumference than the grooves of the lower draw force module.

At full draw, the arc defined by the length of cable in the first groove has a radius that is preferably greater than the radius of the arc defined by the length of cable in the second groove. However, at full draw, the radius defined by the arcs of the two lengths of cable could be the same. If this were to occur, both cables would be pulling at equal radius points, and a 100% letoff would occur.

A draw stop, known in the art as a peg, is attached to a draw force module which contacts the limb at a desired point, may be employed to stop rotation before a point of equal radius, so that the bowstring will move forward on release. In the illustrated embodiment, because the minimum radius of the first groove (i.e., the arc defined by the length of cable in the first groove) is larger than the radius of the second groove (i.e., the arc defined by the length of cable in the second groove), the draw force module will not be rotated to a position in which the point of equal radius is reached. Hence, in the illustrative embodiment, a draw stop is not necessary. Nonetheless, many archers prefer to have a draw stop, because they feel it enables the archer to always have the same amount of pull on the bow string, and facilitates holding the bowstring at full draw, and thus facilitates aiming and shooting of an arrow with the bow.

The above examples and disclosure are intended to be illustrative and not exhaustive.

I claim:

1. An archery bow having a handle and first and second limbs attached to and extending from opposite ends of said handle;

upper and lower draw force modules mounted on the ends of said limbs to rotate about an axis of rotation, the draw force modules each defining a first groove and a second groove;

a bowstring secured at a first end to the first groove of said upper draw force module and secured at a second end to the first groove of said lower draw force module; said bowstring lying at least partially in said first grooves of said upper and lower draw force modules, such that, when said bowstring is pulled, the draw force modules will rotate about their respective axes of rotation;

a first cable secured at a first end to the first groove of said upper draw force module and secured at a second end to the second groove of said lower draw force module; and a second cable secured at a first end to the second groove of said upper draw force module and secured at a second end to the first groove of said lower draw force module;

said bowstring, first cable and second cable being connected to the rotatable draw force modules such that, that as the bowstring is drawn, the bowstring is spooled off a portion of the first grooves of said draw force modules, said first and second cables are spooled on a portion of the first groove of said draw force modules, and the first and second cables are spooled off the second grooves of said draw force modules.

2. The archery bow of claim 1 wherein the axis of rotation of at least one of the draw force modules is generally centered with respect to one of the first and grooves and is off-center with respect to the other of the first and second grooves.

3. The archery bow of claim 1 wherein one of said first and second grooves has a greater circumference than the other of said first and second grooves.

4. The archery bow of claim 3 wherein said second groove is positioned relative to said first groove such that at some point on the first and second grooves, the distance from the first groove to the axle is substantially equal to the distance from the second groove to the axle.

5. The archery bow of claim 1 wherein one of said grooves is non-circular and has a varying radius.

6. The archery bow of claim 5 wherein, the distance between the second groove and the axle is less than the distance between the first groove and the axle, for at least part of the groove.

7. The archery bow of claim 1 at least one of said grooves is generally circular.

8. The archery bow of claim 1 wherein at least the grooves of said draw force modules are coated with a low friction coating.

9. The archery bow of claim 7 wherein said low friction coating is a polytetrafluoroethylene coating.

10. The archery bow of claim 1 wherein one of said first and second grooves is non-circular in shape and has a varying radius and the other of said grooves is generally circular in shape.

* * * * *